US010085304B2

(12) United States Patent
Garde Aranda et al.

(10) Patent No.: US 10,085,304 B2
(45) Date of Patent: Sep. 25, 2018

(54) COOKTOP DEVICE

(71) Applicant: BSH BOSCH UND SIEMENS HAUSGERÄTE GMBH, München (DE)

(72) Inventors: Ignacio Garde Aranda, Saragossa (ES); Estefania Gella Lopez, Saragossa (ES); Oscar Gracia Campos, Saragossa (ES); Javier Herrera Rodriguez, Saragossa (ES); Ramon Peinado Adiego, Saragossa (ES); Alberto Ignacio Sin Use, Saragossa (ES); Demetrio Torrubia Marco, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 190 days.

(21) Appl. No.: 14/904,705

(22) PCT Filed: Jul. 18, 2014

(86) PCT No.: PCT/IB2014/063204
§ 371 (c)(1),
(2) Date: Jan. 13, 2016

(87) PCT Pub. No.: WO2015/015360
PCT Pub. Date: Feb. 5, 2015

(65) Prior Publication Data

US 2016/0157301 A1 Jun. 2, 2016

(30) Foreign Application Priority Data

Jul. 31, 2013 (ES) ..... 201331187

(51) Int. Cl.
*H05B 6/12* (2006.01)
*H05B 6/06* (2006.01)
*H05B 3/68* (2006.01)

(52) U.S. Cl.
CPC ..... *H05B 6/062* (2013.01); *H05B 3/68* (2013.01); *H05B 2203/037* (2013.01); *H05B 2213/03* (2013.01)

(58) Field of Classification Search
CPC ..... H05B 6/062; H05B 6/065; H05B 6/1209; H05B 6/1254; H05B 6/1272; H05B 6/68;
(Continued)

(56) References Cited

U.S. PATENT DOCUMENTS 3,953,711 A 4/1976 Eck et al.
2007/0164017 A1* 7/2007 Gouardo ..... H05B 6/065 219/626

(Continued)

FOREIGN PATENT DOCUMENTS

EP 2242328 A2 10/2010
WO 2009016124 A1 2/2009

OTHER PUBLICATIONS

International Search Report PCT/IB2014/063204 dated Nov. 4, 2014.

*Primary Examiner* — Hung D Nguyen
(74) *Attorney, Agent, or Firm* — Michael E. Tschupp; Andre Pallapies; Branon G. Braun

(57) ABSTRACT

A cooktop device includes at least one heater arrangement, and at least one control unit configured to define in at least one operating mode a number of virtual heating zones with different heat output densities depending on a size of the cookware. The virtual heating zones are formed by adjacently arranged heating elements of the heater arrangement of a number or size sufficient to heat the cookware.

23 Claims, 3 Drawing Sheets

(58) Field of Classification Search
CPC ..... H05B 2213/03; H05B 2213/04; H05B 2213/05; H05B 2213/07; H05B 2203/037
USPC ..... 219/620, 622, 624, 625, 626, 662, 671, 219/672, 445.1, 447.1, 448.13, 462.1, 518
See application file for complete search history.

(56) References Cited

U.S. PATENT DOCUMENTS

| | | | | |
|---|---|---|---|---|
| 2010/0243642 | A1 | 9/2010 | Gouardo et al. | |
| 2012/0255946 | A1* | 10/2012 | Kim ..... | H05B 6/065 219/622 |

* cited by examiner

COOKTOP DEVICE

BACKGROUND OF THE INVENTION

A cooktop device, namely an induction cooktop device, with a heater arrangement having two heating elements, which are arranged adjacent to one another and are provided to heat positioned cookware, and having a control unit, have already been proposed.

BRIEF SUMMARY OF THE INVENTION

The object of the invention consists in providing a generic device with improved properties in respect of high operator comfort. The object is achieved according to the features of the invention.

The invention is based on a cooktop device, in particular an induction cooktop device, with at least one heater arrangement, having at least two, in particular at least three, advantageously at least four heating elements, which are arranged adjacent to one another and are provided at least to heat positioned cookware, and with at least one control unit.

It is proposed that the control unit is provided to define, in at least one operating mode, a number of virtual heating zones having different heat output density depending on a size of at least one positioned piece of cookware, wherein the virtual heating zones are formed by heating elements arranged adjacent to one another, which are suitable by the number and/or size thereof for using the cookware. A "heater arrangement" is to be understood to mean in particular a unit having at least two, in particular at least three, advantageously at least four heating elements, which are defined by the arrangement of heating elements. In particular, the cooktop device comprises at least two heater arrangements, which each have at least two, in particular at least three, advantageously at least four heating elements. A "heating element" is to be understood to mean in particular an element which is provided to transmit, in at least one operating mode, electrical energy at least largely to a piece of cookware, preferably through at least one base body forming a cooktop, and/or to convert electrical energy into heat, in order in particular to heat at least one positioned piece of cookware, preferably through at least one base body forming a cooktop. In particular, the heating element is provided to transmit, in at least one operating mode, in which the heating element is connected to an electronic supply system, an output of at least 100 W, in particular at least 500 W, advantageously at least 1000 W, preferably at least 2000 W. In particular, the heating element is embodied as an induction heating element. An "induction heating element" is to be understood in particular to mean a wound electrical conductor, through which high-frequency alternating current flows in at least one operating mode. In particular, the induction heating element is provided to convert electrical energy into a magnetic alternating field, which is provided, in a metallic, preferably at least partially ferromagnetic, piece of cookware, to cause eddy currents and/or non-magnetization effects, which are converted into heat. The induction heating element is preferably provided to cause the piece of cookware to heat up. The induction heating element is preferably provided in the operating mode to convert electrical energy into electromagnetic field energy, which is finally converted into heat in a suitable piece of cookware. In particular, the cooktop device has at least one base body at least for positioning cookware. In particular, the base body at least substantially forms a cooktop. The phrase that two heating elements are arranged 'adjacent to one another' is in particular understood to mean that a shortest straight line connecting the heating elements starting from a first of the heating elements only intersects the first heating element and a second of the heating elements, which is embodied separately from the first heating element, particularly by avoiding a further heating element between the two heating elements, wherein a distance between the further heating element and at least one of the adjacently arranged heating elements is at least as large as a distance between the adjacently arranged heating elements. A "control unit" is in particular understood to mean an electronic unit, which is preferably integrated at least partially in a control and/or regulating unit of a cooktop and which is preferably provided to at least control and/or regulate the heating elements. The control unit preferably comprises a computing unit and in particular in addition to the computing unit a storage unit with a control and/or regulating program stored therein, which is provided to be embodied by the computing unit. The cooktop device advantageously has at least one sensor unit, which is formed in particular itself from the heating elements, which is provided to detect positioned cookware in particular by means of measuring at least one inductance and/or at least one capacitance. In particular, the control unit is provided to evaluate measured values of the sensor unit, to calculate at least one heating zone and to define heating elements which form this heating zone. In particular, the control unit is provided to assign a heating zone which is adjusted in terms of shape, size and/or position to a detected piece of cookware. In particular, the control unit is provided to enable at least a detection of a positioned piece of cookware by means of the sensor unit by means of activating at least one of the heating elements, in particular the majority of or, advantageously all heating elements. Alternatively, further possibilities which appear meaningful to a person skilled in the art are conceivable to detect positioned cookware. In particular, the sensor unit is provided to detect at least one variable of the positioned cookware. In particular, the control unit is provided to determine a size of a positioned cookware by means of a number of heating elements covered by the cookware. In particular, the control unit is provided to effect at least a regular detection of positioned cookware, in particular by means of the sensor unit. The phrase that the control unit is provided to effect a "regular" detection of the positioned cookware is in particular to be understood to mean that the control unit is provided to effect a detection of the positioned piece of cookware at temporal intervals of less than 30 s, in particular less than 10 s, advantageously less than 5 s, particularly advantageously less than 1 s, preferably less than 0.1 s. The phrase that the control unit is provided to 'effect' at least a regular detection of the positioned cookware is in particular to be understood to mean that the control unit is provided to enable at least a regular detection of the positioned cookware by activating at least one, in particular at least a majority of, advantageously all heating elements. In particular, the control unit is provided to divide a cooktop area formed of the heater arraignment into a number of virtual heating zones at least in one operating mode, in particular at least in the operating mode depending on a size of at least one positioned piece of cookware. In particular, a number of virtual heating zones are inversely proportional to the size of the positioned cookware. In particular, a number of virtual heating zones reduce with an increasing size of the positioned cookware. In particular, the control unit is provided to assign, in at least one operating mode, in particular in at least the operating mode of a first virtual heating zone, a first heat output density and as a function of the first heat output density, to define heat output densities of further virtual heating zones, which differ in particular from the first virtual heating zone. In particular, the control unit is provided, in at least one operating mode, in particular in at least the operating mode, to assign a second heat output destiny to a second virtual heating zone, which is embodied separately from the first virtual heating zone, said second heat output density differing in particular from the first heat output density of the first virtual heating zone. The phrase that the virtual heating zones are formed of adjacently arranged heating elements, which are 'suitable' by the number and/or size thereof for operating the cookware, is in particular to be understood to mean that a number and/or size of the virtual heating zones is substantially equal to a number and/or size of the positioned cookware. In particular, the control unit is provided to combine heating elements covered by one, in particular precisely by a first piece of cookware, to form a first heating zone. In particular, the control unit is provided to divide the cooktop area formed by the heater arrangement into a number of virtual heating zones, the size of which is substantially equal to a size of the first heating zone. In particular, the virtual heating zones are formed by a substantially similar number of heating elements as the first heating zone. In particular, a size of the virtual heating zones is substantially equal to a size of the first heating zone. In particular, the control unit is provided, with a size of at least one piece of positioned cookware which covers more than one heating element, to assign at least one heating element to at least two virtual heating zones. In particular, at least one heating element is part of at least two virtual heating zones. "Provided" is understood to mean in particular especially programmed, configured and/or equipped. The fact that an object is provided for a specific function is in particular to be understood to mean that the object fulfills and/or executes this function in at least one application and/or operating state.

High comfort for an operator can be achieved in particular by means of the inventive embodiment. In particular, an effective heating of positioned cookware and/or an advantageous heat distribution can be achieved. In particular, a cost-effective and/or energy-saving embodiment can be achieved.

Moreover, it is proposed that the control unit is provided, in at least one operating mode, in particular in at least the operating mode, to operate the virtual heating zones in a position dependent manner with predefined heat output densities which differ from one another. In particular, the control unit is provided to assign a predefined heat output density at least to one of the, in particular a majority of, advantageously each of the virtual heating zones, said predefined heat output density differing in particular from a predefined heat output density of further virtual heating zones. In particular, a predefined, individual heat output density is stored in the storage unit of the control unit to form at least one of, in particular a majority of, advantageously each of the virtual heating zones. In particular, at least one predefined heat output density of at least one virtual heating zone can be changed by an operator, in particular before the start of a cooking process and/or during a cooking process and/or after a cooking process has ended. In particular, the control unit is provided to change further heat output densities of further virtual heating zones as a function of the change in the predefined heat output densities of the first virtual heating zone. The phrase that the control unit is provided "to assign" a heat output density to a virtual heating zone is in particular to be understood to mean that the control unit is provided to operate the virtual heating zone with the heat output density which is assigned to the virtual heating zone during activation of the virtual heating zone. The phrase that the control unit is provided 'to operate' at least one virtual heating zone is in particular to be understood to mean that the control unit is provided to actuate at least one electronic supply system, which supplies the virtual heating zone. In particular, the electronic supply system comprises at least one heat frequency unit for supplying at least one virtual heating zone. A "heat frequency unit" is in particular to be understood to mean an electrical unit, which generates an oscillating electrical signal, preferably with a frequency of at least 1 kHz, in particular at least 10 kHz, advantageously at least one 20 kHz and in particular at most 100 kHz for a heating element. In particular, the heat frequency unit is provided to provide a maximum electrical output required by the heating element of at least 1000 W, in particular at least 2000 W, advantageously at least 3000 W and preferably at least 3500 W. The heat frequency unit comprises in particular at least one inverter, which preferably has at least two, bidirectional, unipolar switches which are preferably connected in series and which are formed in particular by a transistor and a diode connected in parallel, and particularly advantageously at least one damping capacitor connected in parallel to the bidirectional unipolar switches in each case, which is formed in particular by at least one capacitor. As a result, high operator comfort can in particular be achieved, which can change a change in a heat output density of the cookware by means of a change in position of the cookware.

It is further proposed that the control unit is provided, in at least one operating mode, in particular in at least the operating mode, to assign a higher heat output density to a virtual heating zone, which is arranged in an area facing an operator, than a virtual heating zone, which is arranged in an area facing away from an operator. It is alternatively conceivable for the control unit to be provided, at least in one operating mode, to assign a lower heat output density to a virtual heating zone, which is arranged in an area facing an operator, than a virtual heating zone, which is arranged in an area facing away from an operator. In particular, the control unit is provided, in at least one operating mode, in particular in at least the operating mode, to assign a highest heat output density of all virtual heating zones, in particular in comparison with further virtual heating zones, of at least one cooktop area, to a virtual heating zone, which is arranged in the area facing an operator. In particular, the control unit is provided, at in least one operating mode, in particular in at least the operating mode, to assign a lowest heat output density of all virtual heating zones, in particular in comparison with further virtual heating zones, of at least one cooktop area, to a virtual heating zone, which is arranged in the area facing away from an operator. In particular, the control unit is provided, in at least one operating mode, in particular in at least the operating mode, to assign different heat output densities to virtual heating zones depending on a distance from the area facing an operator. As a result, high operator comfort can in particular be achieved. In particular, an operator can prepare food in the area facing the operator. Moreover, an operator can position prepared food to stay warm in the area facing away from the operator, in order in particular to be able to conveniently prepare food in the area facing the operator.

It is further proposed for the control unit to be provided to change, as a function of an operator input by means of at least one control unit between the operating mode and at least one further operating mode, in particular at least two further operating modes. In particular, the control unit is provided to operate the heating elements with independent heat output densities in at least one first further operating mode. In particular, heat output densities can also be freely selected in the first further operating mode, particularly by avoiding an influence of further heat output densities of further heating elements. In particular, a first heat output density of a first heating element can be freely selected in the first further operating mode by a control input by means of the control unit. In particular, a second heat output density of a second heating element can be freely selected in the first further operating mode by a control input by means of the control unit, particularly by avoiding influencing the first heat output density of the first heating element. In particular, the control unit is provided, in at least one second further operating mode, to operate the heating elements in a position-dependent manner with predefined heat output densities which differ from one another. A "control input" is in particular understood to mean an actuation of the control unit by an operator. As a result, a flexible embodiment can be achieved in particular. Moreover, an operator can advantageously conveniently change between different operating modes at will.

It is further proposed that at least one part of the heating elements embodies a variable cooktop area. In particular, heating elements of the heater arrangement form the variable cooktop area. In particular, the heater arrangement is embodied as a variable cooktop area. A "variable cooktop area" is in particular understood to mean a cooktop area which is provided to form at least one cooking zone adjusted to at least one positioned piece of cookware. In particular, the variable cooktop area differs from a cooktop in which heating zones, in particular by markers on the cooktop, are fixedly predetermined. In particular, the variable cooktop area is formed of at least two, in particular of at least three, advantageously of at least four heating elements. In particular, the heating elements embodying the variable cooktop area are arranged in a single row. A "row" is understood in particular to mean a line and/or column and/or a strip. In particular, the heating elements are arranged adjacent to one another, in particular in rows, along a row longitudinal direction connecting the heating elements, which is embodied in particular as a straight line. The row longitudinal direction in particular connects centers of gravity of the heating elements. It is likewise conceivable for the heating elements to be arranged offset, wherein centers of gravity of the heating elements relative to a straight line, which is aligned at least substantially parallel to the row longitudinal direction and which connects the heating elements at least substantially centrally with one another, have a distance which is less than 50%, in particular less than 40%, advantageously less than 30% of a sum of at least one extension, in particular a longitudinal extension and/or a transverse extension, of at least one of the heating elements forming the row. An "individual" row of at least two heating elements is in particular to be understood as a row, in which the heating elements are arranged adjacent to one another in, in particular precisely, one row longitudinal direction, wherein the control unit is provided to form at least one cooking zone adjusted to at least one positioned piece of cookware from the heating elements arranged adjacent to one another in the row longitudinal direction. In particular, at least one further heating element, which is embodied separately from the heating elements forming the row and part of a further row embodied separately from the row, is arranged at a distance from each of the heating elements forming the row. In particular, the further heating element has a distance from each heating element forming the row in respect of a row transverse direction, which is aligned at least substantially at right angles to the row longitudinal direction, said distance being greater than 15%, in particular greater than 30%, advantageously greater than 40%, preferably greater than 50%, particularly preferably greater than 75% of a sum of at least one extension, in particular a longitudinal extension and/or a transverse extension, of at least one of the heating elements forming the row. The phrase that a straight line and/or plane is aligned "at least substantially at right angles" to a further straight line and/or plane embodied separately from a straight line and/or plane, is in particular understood to mean that the straight line and/or plane cuts an angle with the further straight line and/or plane when projected onto at least one projection plane in which at least one of the straight lines and/or one of the planes is arranged, said angle preferably deviating by less than 15°, advantageously by less than 10° and in particular by less than 5° from an angle of 90°. Alternatively or in addition, it is conceivable for at least one part of the heating elements to be embodied as a conventional cooktop. It is likewise conceivable for one part, in particular substantially 50% of a cooktop to be embodied as a conventional cooktop and a further part, in particular substantially 50% of the cooktop to be embodied as a variable cooktop area. A high degree of flexibility can be achieved as a result.

BRIEF DESCRIPTION OF THE DRAWINGS

Further advantages result from the description of the drawings below. Exemplary embodiments of the invention are shown in the drawing. The drawing, the description and the claims contain numerous features in combination. The person skilled in the art will also expediently consider the features individually and combine them to form further meaningful combinations, in which:

DETAILED DESCRIPTION OF EXEMPLARY EMBODIMENTS OF THE PRESENT INVENTION

Figure 1:
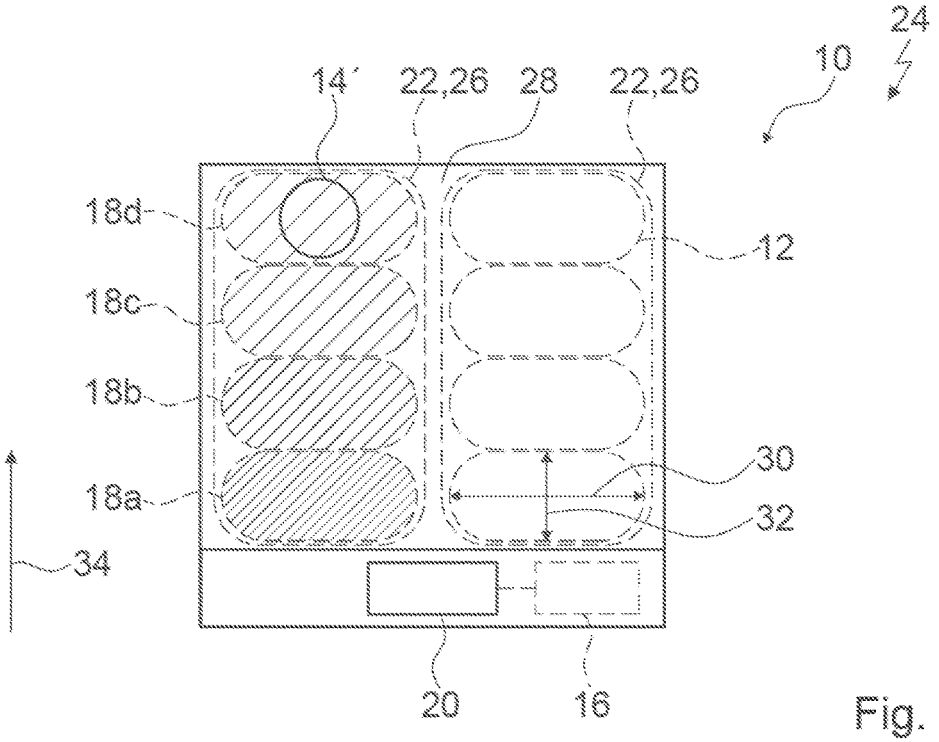
FIG. 1 shows an inventive cooktop with an inventive cooktop device in a schematic top view, wherein a first piece of cookware is shown in a first position.

FIGS. 1 to 5 show in each case an inventive cooktop 24, which is embodied as an induction cooktop, having an inventive cooktop device 10, which is embodied as an induction cooktop device. The cooktop device 10 has a base body 28 for positioning pieces of cookware 14. The base body 28 forms a cooktop. The cooktop device 10 comprises two heater arrangements 26. Each of the heater arrangements 26 comprises four heating elements 12 to heat positioned cookware 14, which are arranged adjacent to one another. For the sake of clarity, FIGS. 1 to 5 show in each case only one of the heating elements 12 with a reference character. The heating elements 12, which are embodied as induction heating elements, are arranged below the base body 28. The heating elements 12 are provided in each case to heat a piece of cookware 14 positioned on the base body 28 above the heating elements 12. The heating elements 12 are embodied as elongated heating elements 12. Each heating element 12 has a longitudinal extension 30, which is larger than a transverse extension 32 of the heating element 12.

Four of the heating elements 12 form a variable cooktop area 22 in each case. The four heating elements 12 of one of the heater arrangements 26 form a variable cooktop area 22 here. Each heater arrangement 26 forms one of the variable cooktop areas 22. The two variable cooktop areas 22 are arranged adjacent to one another. A first of the variable cooktop areas 22 is arranged on a first side of the base body 28. A second of the variable cooktop areas 22 is arranged on a second side of the base body 28, which faces the first side. The heating elements 12 forming the variable cooktop areas 22 are arranged in each case in an individual row. The heating elements 12 forming the individual row are arranged one behind the other in respect of a row longitudinal direction 34. The row longitudinal direction 34 is aligned substantially at right angles to the longitudinal extension 30 of the heating elements 12. The row longitudinal direction 34 extends starting from an area of the base body 28 facing an operator in the integrated state in the direction of an area of the base body 28 facing away from an operator in the integrated state. The heating elements 12 forming the individual rows have a distance in respect of the row longitudinal direction 34, which is substantially smaller than the transverse extension 32 of the heating elements 12 aligned substantially in parallel with the row longitudinal direction 34.

In the area facing an operator in the integrated state, the cooktop device 10 has a control unit 20 for inputting operating parameters. For instance, the control unit is provided to select and/or change a heating zone. Moreover, the control unit could be provided to set a heating output and/or heat output density of a heating zone. It is likewise conceivable for the control unit to be embodied to select and/or change a cooking time and/or a cooking program. It is further conceivable for the control unit to be provided to change an operating mode and/or operating state. Alternatively, further embodiments of the control unit and/or operating parameter which appear meaningful to a person skilled in the art are conceivable. The cooktop device 10 comprises a control unit 16 for controlling and regulating the heating elements 12. The control unit 16 is provided to perform actions and/or to change settings as a function of the operating parameters entered by means of the control unit 20.

The cooktop device 10 comprises a sensor unit for detecting a positioned piece of cookware 14. The sensor unit is embodied substantially in one piece with the heating elements 12, and is provided to detect positioned cookware 14 by measuring at least one inductance. The control unit 16 and the sensor unit are connected electrically. The control unit 16 and the sensor unit are connected electrically. In a method for operating the cooktop device 10, the control unit 16 defines a number of virtual heating zones 18 with different heat output densities in an operating mode as a function of a size of a positioned piece of cookware 14. Here the control unit 16 combines adjacently arranged heating elements 12 of one of the heater arrangements 26 to form virtual heating zones 18. The control unit 16 adjusts a size of the virtual heating zones 18 to a size of the positioned cookware 14. For instance, a first cookware 14' is positioned on precisely one heating element 12. In the operating mode, the control unit 16 defines four virtual heating zones 18*a*, 18*b*, 18*c*, 18*d* with different heat output densities, which are formed in each case of precisely one heating element 12 (cf. FIG. 1). The virtual heating zones 18*a*, 18*b*, 18*c*, 18*d* are formed of adjacently arranged heating elements 12, which are suitable by the number and/or size thereof for using the cookware 14'.

Each of the virtual heating zones 18*a*, 18*b*, 18*c*, 18*d* has a different heat output density. The control unit 16 assigns a first heat output density in the operating mode to a first virtual heating zone 18*a*. To this end, the control unit 16 selects a virtual heating zone 18 facing an operator. Alternatively it is conceivable for the control unit to select a virtual heating zone facing away from an operator. It is likewise conceivable for the control unit to select a virtual heating zone, which is covered by the positioned cookware. The control unit 16 defines, as a function of the first heat output density, heat output densities of further virtual heating zones 18*b*, 18*c*, 18*d*, which differ from the first virtual heating zone 18*a*. The first heat output density of the first virtual heating zone 18*a*, which is arranged in the area facing an operator in the integrated state, is larger than the heat output densities of the further virtual heating zones 18*b*, 18*c*, 18*d*, which are formed of heating elements 12 of the same heater arrangement 26 as the first virtual heating zone 18*a*. The first heat output density of the first virtual heating zone 18*a* is greater than a second heat output density of a second virtual heating zone 18*b*, which is arranged adjacent to the first virtual heating zone 18*a* in the row longitudinal direction 34. The second heat output density of the second virtual heating zone 18*b* is greater than a third heat output density of a third virtual heating zone 18*c*, which is arranged adjacent to the second virtual heating zone 18*b* in the row longitudinal direction 34. The third heat output density of the third virtual heating zone 18*c* is greater than a fourth heat output density of a fourth virtual heating zone 18*d*, which is arranged adjacent to the third virtual heating zone 18*d* in the row longitudinal direction 34. The fourth heat output density of the fourth virtual heating zone 18*d*, which is arranged in an area facing away from an operator in the integrated state, is less than the heat output densities of the further virtual heating zones 18*a*, 18*b*, 18*c*, which are formed of heating elements 12 of the same heater arrangement 26 as the fourth virtual heating zone 18*a*.

The control unit 16 operates a virtual heating zone 18 assigned to a positioned cookware 14 as a function of a position of the cookware 14 with different heat output densities. The control unit 16 operates the virtual heating zones 18 in row longitudinal direction 34 with different heat output densities. Here the control unit 16 operates a virtual heating zone 18*a*, 18*e*, 18*h* arranged in an area facing an operator with different heat output densities than a virtual heating zone 18*d*, 18*g*, 18*i* arranged in an area facing away from an operator in the integrated state. The control unit 16 comprises a storage unit, in which a heat output density is stored relative to each virtual heating zone 18 as a function of a position of the virtual heating zone 18. The heat output densities of a large part of the virtual heating zones 18, namely one of each of the virtual heating zones 18 differ from one another. In the operating mode, the control unit 16 operates the virtual heating zones 18 in a position-dependent manner with predefined heat output densities which differ from one another. A predefined heat output density of a virtual heating zone 18*a*, 18*e*, 18*h* arranged in the integrated state in the region facing an operator is greater than a predefined heat output density of a virtual heating zone 18*d*, 18*g*, 18*i* arranged in the integrated state in the region facing away from an operator. In the operating mode, the control unit 16 assigns a higher heat output density to a virtual heating zone 18*a*, 18*e*, 18*h*, which is arranged in the region facing an operator, than to a virtual heating zone 18*d*, 18*b*, 18*i*, which is arranged in the region facing away from an operator.

As a function of a control input by means of the control unit 20, the control unit 16 changes an assignment of the predefined heat output densities which differ from one another to the individual virtual heating zones 18. A control input by means of the control unit 20 causes the control unit 16 to change between a first sub-operating mode and a second sub-operating mode during an activated operating mode. In the first sub-operating mode, a virtual heating zone 18*a* arranged in the area facing an operator in the integrated state has a larger heat output density than a virtual heating zone 18*d* (cf. FIG. 1) arranged in the area facing away from an operator in the integrated state. In the second sub-operating mode, a virtual heating zone 18*a* arranged in the area facing an operator in the integrated state has a lower heat output density than a virtual heating zone 18*d* (not shown) arranged in the area facing away from an operator in the integrated state.

Figure 2:
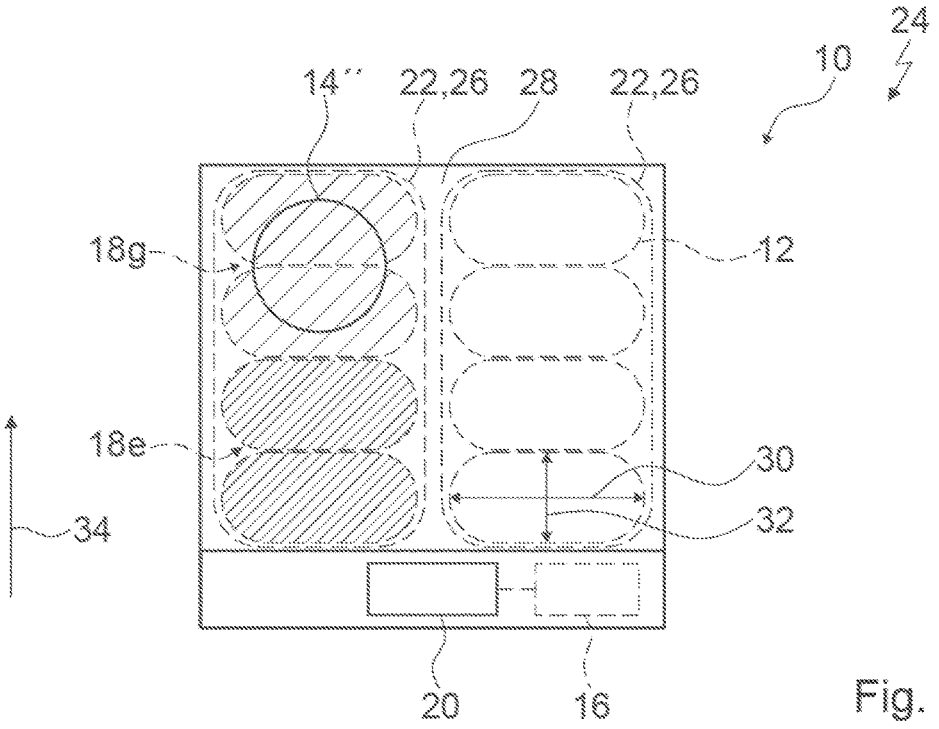
FIG. 2 shows an inventive cooktop with the inventive cooktop device from FIG. 1 in a schematic top view, wherein a second piece of cookware is shown in a first position.
Figure 3:
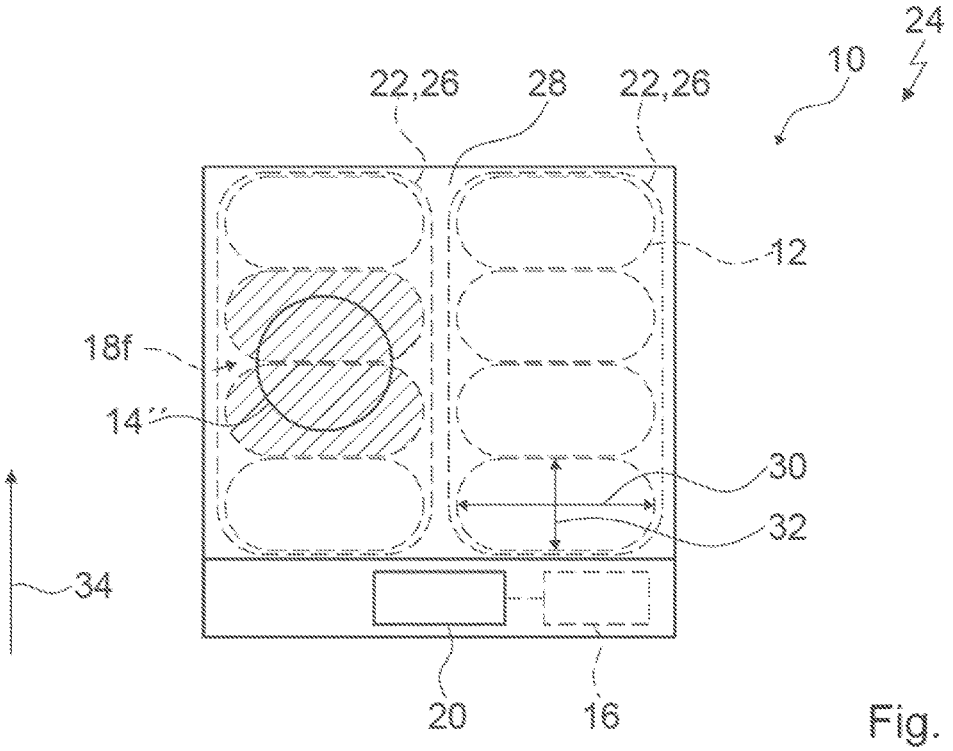
FIG. 3 shows the inventive cooktop with the inventive cooktop device from FIG. 2 in a schematic top view, wherein the second piece of cookware is shown in a second position.

If a second piece of cookware 14" is alternatively positioned, which covers two adjacently arranged heating elements 12, the control unit 16 in the operating mode defines three virtual heating zones 18*e*, 18*f*, 18*g* with different heat output density, which are formed in each case of two adjacently arranged heating elements 12 of one of the heater arrangements 26 (cf. FIGS. 2 and 3). Each of the virtual heating zones 18*e*, 18*f*, 18*g* has a different heat output density. The control unit 16 assigns a first heat output density in the operating mode to a first virtual heating zone 18*e*. The first heat output density of the first virtual heating zone 18*e*, which is arranged in the area facing an operator in the integrated state, is larger than the heat output densities of the further virtual heating zones 18*f*, 18*g*, which are formed of heating elements 12 of the same heater arrangement 26 as the first virtual heating zone 18*e*. A second heat output density of the second virtual heating zone 18*f* is lower than the first heat output density of the first virtual heating zone 18*e* and is greater than a third heat output density of the third virtual heating zone 18*g*. The third heat output density of the third virtual heating zone 18*g*, which is arranged in an area facing away from an operator in the integrated state, is lower than the heat output densities of the further virtual heating zones 18*e*, 18*f*, which are formed of heating elements 12 of the same heater arrangement 26 as the third virtual heating zone 18*g*.

Figure 4:
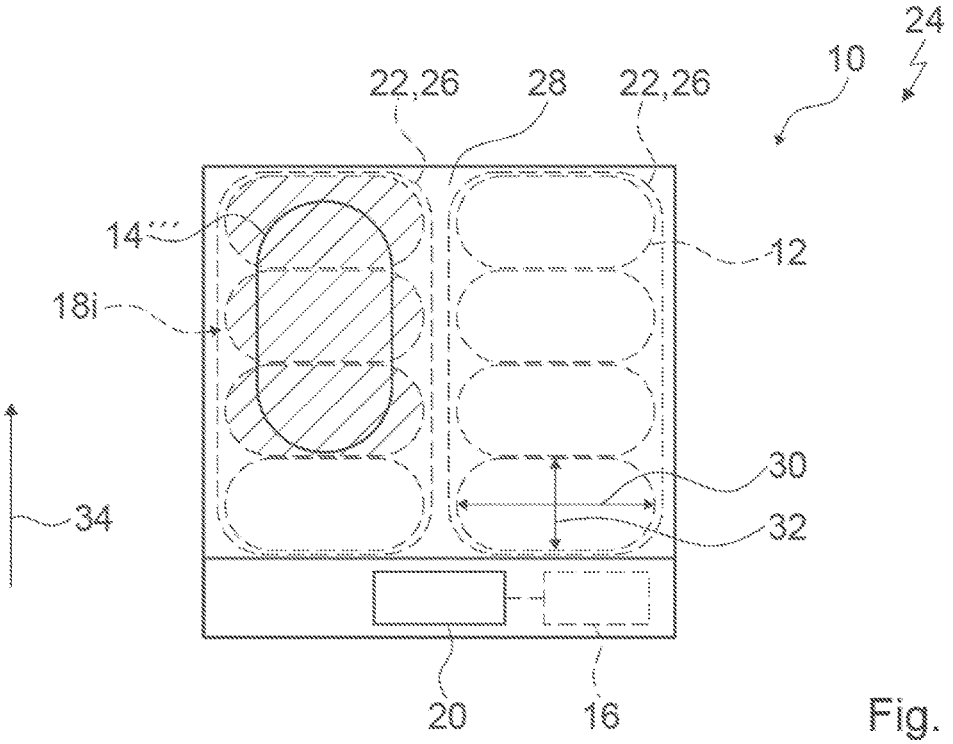
FIG. 4 shows the inventive cooktop with the inventive cooktop device from FIG. 1 in a schematic top view, wherein a third piece of cookware is shown in a first position
Figure 5:
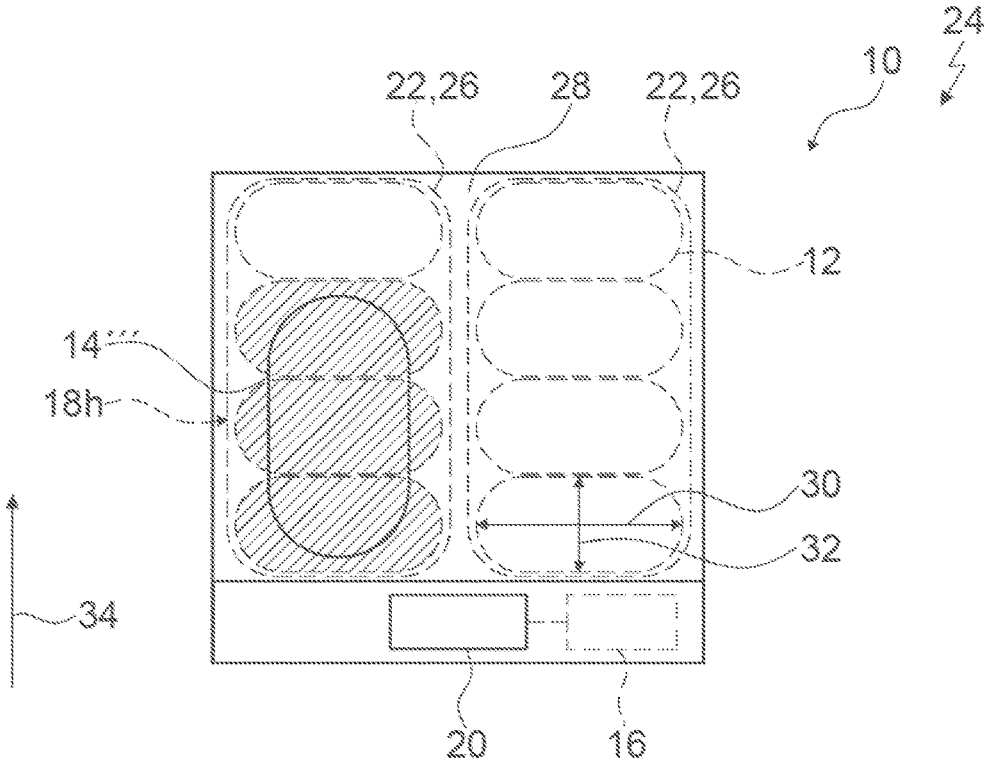
FIG. 5 shows the inventive cooktop with the inventive cooktop device from FIG. 5 in a schematic top view, wherein the third piece of cookware is shown in a second position.

If as an alternative to the first piece of cookware 14' and the second piece of cookware 14" a third piece of cookware 14" is positioned, which covers three adjacently arranged heating elements 12, the control unit 16 in the operating mode defines two virtual heating zones 18*h*, 18*i* with different heat output densities, which are formed in each case of two adjacently arranged heating elements 12 of one of the heater arrangements 26 (cf. FIGS. 4 and 5). The virtual heating zones 18*h*, 18*i* have different heat output densities. The control unit 16 assigns a first heat output density in the operating mode to a first virtual heating zone 18*h*. The first heat output density of the first virtual heating zone 18*h*, which is arranged in the region facing an operator in the integrated state, is greater than a second heat output density of a second virtual heating zone 18*i*, which is formed of heating elements 12 of the same heater arrangement 26 as the first virtual heating zone 18*h*. The second virtual heating zone 18*i* is arranged in an area facing away from an operator in the integrated state.

The control unit 16 changes a predefined heat output design of one of the virtual heating zones 18 stored in the storage unit as a function of a control input by means of the control unit 20. With a change in a predefined heat output density of a first virtual heating zone 18, the control unit 16 changes heat output densities of the further virtual heating zones 18 as a function of the change in the predefined heat output density of the first virtual heating zone 18, said virtual heating zones 18 being formed of heating elements 12 of the same heater arrangement 26 as the first virtual heating zone 18. Moreover, the control unit 16 changes between the operating mode and two further operating modes as a function of a control input by means of the control unit 20. In a first further operating mode, the control unit 16 operates the heating elements 12 with heat output densities which are independent of one another. In a second further operating mode, the control unit 16 operates the heating elements 12 in a position dependent manner with predefined heat output densities which differ from one another. If a virtual heating zone 18 is formed of precisely one heating element 12, the second further operating mode is substantially the same as the operating mode. If a virtual heating zone 18 is formed of more than one heating element 12, the second further operating mode differs from the operating mode.

The invention claimed is:

1. A cooktop device, comprising:

at least one heater arrangement; and at least one control unit configured to define in at least one operating mode a number of virtual heating zones, each of the number of virtual heating zones having substantially the same size which depends on a size of the cookware, the virtual heating zones being formed by adjacently arranged heating elements of the heater arrangement of a number or size sufficient to heat the cookware, wherein the control unit is configured to assign in at least one operating mode different heat output densities to the virtual heating zones, the control unit assigning a higher heat output density to one of the virtual heating zones which is arranged in a region facing an operator, than to another one of the virtual heating zones which is arranged in a region facing away from an operator.

2. The cooktop device of claim 1, constructed in the form of an induction cooktop device.

3. The cooktop device of claim 1, wherein the control unit is configured to assign in the at least one operating mode a first heat output density to a first one of the virtual heating zones, and to define as a function of the first heat output density a heat output density of a further one of the virtual heating zones, which density heat output density of the further one of the virtual heating zones differs from the first heat output density of the first one of the virtual heating zones.

4. The cooktop device of claim 1, wherein the control unit is configured to operate in at least one operating mode the virtual heating zones in a position-dependent manner with predefined heat output densities which differ from one another.

5. The cooktop device of claim 1, further comprising an operating unit operably connected to the control unit, said control unit being configured to change between the at least one operating mode and at least one further operating mode as a function of a control input by the operating unit.

6. The cooktop device of claim 1, wherein the heater arrangement has at least three heating elements.

7. The cooktop device of claim 1, wherein at least some of the heating elements form a variable cooktop area.

8. The cooktop device of claim 7, wherein the heating elements that form the variable cooktop area are arranged in a single row.

9. A cooktop, comprising:

a cooktop device which includes at least one heater arrangement, and at least one control unit configured to define in at least one operating mode a number of virtual heating zones, each of the number of virtual heating zones having substantially the same size which depends on a size of the cookware, the virtual heating zones being formed by adjacently arranged heating elements of the heater arrangement of a number or size sufficient to heat the cookware, wherein the control unit is configured to assign in at least one operating mode different heat output densities to the virtual heating zones, the control unit assigning a higher heat output density to one of the virtual heating zones which is arranged in a region facing an operator, than to another one of the virtual heating zones which is arranged in a region facing away from an operator.

10. The cooktop of claim 9, wherein the cooktop device is constructed in the form of an induction cooktop device.

11. The cooktop of claim 9, wherein the control unit is configured to assign in the at least one operating mode a first heat output density to a first one of the virtual heating zones, and to define as a function of the first heat output density a heat output density of a further one of the virtual heating zones, which density heat output density of the further one of the virtual heating zones differs from the first heat output density of the first one of the virtual heating zones.

12. The cooktop of claim 9, wherein the control unit is configured to operate in at least one operating mode the virtual heating zones in a position-dependent manner with predefined heat output densities which differ from one another.

13. The cooktop of claim 9, wherein the cooktop device includes an operating unit operably connected to the control unit, said control unit being configured to change between the at least one operating mode and at least one further operating mode as a function of a control input by the operating unit.

14. The cooktop of claim 9, wherein the heater arrangement has at least three heating elements.

15. The cooktop of claim 9, wherein at least some of the heating elements form a variable cooktop area.

16. The cooktop of claim 15, wherein the heating elements that form the variable cooktop area are arranged in a single row.

17. A method for operating a cooktop device, the method comprising:

defining in at least one operating mode of the cooktop device a number of virtual heating zones, each of the number of virtual heating zones having substantially the same size which depends on a size of a cookware, with the virtual heating zones being formed by adjacently arranged heating elements of a heater arrangement of a number or size sufficient to heat the cookware, assigning different heat output densities to the virtual heating zones, a higher heat output density being assigned to one of the virtual heating zones which is arranged in a region facing an operator, than to another one of the virtual heating zones which is arranged in a region facing away from an operator.

18. The method of claim 17, further comprising assigning in the at least one operating mode a first heat output density to a first one of the virtual heating zones, and defining as a function of the first heat output density a heat output density of a further one of the virtual heating zones, which density heat output density of the further one of the virtual heating zones differs from the first heat output density of the first one of the virtual heating zones.

19. The method of claim 17, further comprising operating in at least one operating mode the virtual heating zones in a position-dependent manner with predefined heat output densities which differ from one another.

20. The method of claim 17, further comprising changing between the at least one operating mode and at least one further operating mode as a function of a control input by an operating unit.

21. The method of claim 17, wherein the heater arrangement has at least three heating elements.

22. The method of claim 17, wherein at least some of the heating elements form a variable cooktop area.

23. The method of claim 22, wherein the heating elements that form the variable cooktop area are arranged in a single row.

* * * * *